US011326778B2

(12) United States Patent
McKinney

(10) Patent No.: US 11,326,778 B2
(45) Date of Patent: May 10, 2022

(54) GAS BURNER SYSTEM AND METHOD THEREOF

(71) Applicant: John McKinney, Aztec, NM (US)

(72) Inventor: John McKinney, Aztec, NM (US)

( * ) Notice: Subject to any disclaimer, the term of this patent is extended or adjusted under 35 U.S.C. 154(b) by 0 days.

(21) Appl. No.: 17/391,411

(22) Filed: Aug. 2, 2021

(65) Prior Publication Data

US 2022/0042680 A1 Feb. 10, 2022

Related U.S. Application Data

(60) Provisional application No. 63/062,761, filed on Aug. 7, 2020.

(51) Int. Cl.

| | |
|---|---|
| ***F23D 14/82*** | (2006.01) |
| ***F23Q 9/08*** | (2006.01) |
| ***F23D 14/02*** | (2006.01) |
| ***F23C 7/00*** | (2006.01) |
| ***F23N 5/24*** | (2006.01) |
| ***F23N 3/00*** | (2006.01) |
| ***F23D 23/00*** | (2006.01) |
| ***F23D 99/00*** | (2010.01) |
| *F23G 7/08* | (2006.01) |

(52) U.S. Cl.

CPC ..... *F23D 14/825* (2013.01); *F23C 7/008* (2013.01); *F23D 14/02* (2013.01); *F23D 23/00* (2013.01); *F23D 91/04* (2015.07); *F23N 3/007* (2013.01); *F23N 5/247* (2013.01); *F23Q 9/08* (2013.01); *F23D 2203/007* (2013.01); *F23D 2209/00* (2013.01); *F23G 7/085* (2013.01)

(58) Field of Classification Search

CPC ..... F23D 14/825; F23D 14/02; F23D 14/82; F23D 23/00; F23D 91/04; F23D 2203/007; F23D 2209/00; F23Q 9/08; F23Q 9/10; F23G 7/008; F23N 3/007; F23N 5/247

USPC ..... 431/348, 157, 89, 153, 281

IPC ..... F23D 14/82,14/02, 23/00; F23Q 9/08, 9/10; F23G 7/08; F23C 7/08, 7/00; F23N 3/00

See application file for complete search history.

(56) References Cited

U.S. PATENT DOCUMENTS 2,332,380 A * 10/1943 Hess ..... F23D 14/825 48/192
2,750,000 A * 6/1956 Williams ..... C01B 17/0205 95/253
3,105,855 A * 10/1963 Meyers ..... E21B 43/34 585/15
3,159,473 A * 12/1964 Meyers ..... E21B 43/36 62/657
3,405,509 A * 10/1968 Coggins ..... F22B 35/007 96/173
3,443,883 A * 5/1969 Castle ..... A61L 2/07 422/299
3,450,603 A * 6/1969 Coggins ..... B01D 1/00 203/18

(Continued)

FOREIGN PATENT DOCUMENTS

DE 3429247 A1 * 2/1986 ..... F23N 1/045

*Primary Examiner* — Steven B McAllister
*Assistant Examiner* — Daniel E. Namay
(74) *Attorney, Agent, or Firm* — Sand, Sebolt & Wernow Co., LPA

(57) ABSTRACT

A system for use with a fired vessel of production/separators or dehydration equipment that includes a metal box, a main burner, a pilot burner, and a flame arrestor. The main burner and the pilot burner extend through the metal box and the first flame arrestor is connected to the metal box.

16 Claims, 6 Drawing Sheets

(56) References Cited

U.S. PATENT DOCUMENTS

| | | | | | |
|---|---|---|---|---|---|
| 4,204,833 | A * | 5/1980 | Kmetz | F23N 1/065 | 431/22 |
| 4,534,828 | A * | 8/1985 | Erickson | B01D 1/04 | 159/16.1 |
| 4,702,692 | A * | 10/1987 | Burns | F23L 13/06 | 137/625.31 |
| 5,082,525 | A * | 1/1992 | Travis | B01D 1/0082 | 159/16.1 |
| 5,361,750 | A * | 11/1994 | Seel | F23D 14/02 | 126/91 A |
| 5,934,207 | A * | 8/1999 | Echols | F23G 7/008 | 110/346 |
| 6,312,250 | B1 * | 11/2001 | Neville | F23D 14/60 | 431/1 |
| 6,422,178 | B1 * | 7/2002 | Lannes | F24H 9/1836 | 122/14.31 |
| 7,402,039 | B1 * | 7/2008 | McElroy | F23D 14/60 | 431/354 |
| 8,591,222 | B2 * | 11/2013 | Sherrow | F23N 5/022 | 431/353 |
| 10,711,998 | B2 * | 7/2020 | Perez | F23D 14/12 | |
| 11,187,408 | B2 * | 11/2021 | Hausen | F23D 14/22 | |
| 2011/0104622 | A1 * | 5/2011 | Sherrow | F23N 1/022 | 431/8 |
| 2018/0185969 | A1 * | 7/2018 | Vossberg | F23D 14/825 | |
| 2018/0258814 | A1 * | 9/2018 | MacDonald | F01N 3/10 | |
| 2019/0101283 | A1 * | 4/2019 | Perez | F23D 14/10 | |
| 2020/0340667 | A1 * | 10/2020 | Hausen | F23D 14/62 | |

* cited by examiner

GAS BURNER SYSTEM AND METHOD THEREOF

CROSS REFERENCE TO RELATED APPLICATIONS

This disclosure claims priority to U.S. Provisional Patent Application Ser. No. 63/062,761, filed on Aug. 7, 2020, the entirety of which is incorporated herein by reference.

TECHNICAL FIELD

The present disclosure generally relates to systems in the oil and gas industry. More specifically, the present disclosure relates to fired vessels in the oil and gas industry. Specifically, the present disclosure relates to a burner of a fired vessel in the oil and gas industry.

BACKGROUND

Oil and natural gas may be obtained from reservoirs in cold environments The oil and natural gas may be saturated with water. Oil and natural gas that is saturated with water causes problems for equipment that process the products. For example, at low temperatures, water within oil and natural gas may cause pipes that the oil and natural gas flows through to freeze. In another example, the water may form hydrates with carbon dioxide and hydrocarbons within the oil or natural gas. These hydrates may plug oil and natural gas processing equipment and piping. Fired vessels remove water from oil and natural gas so that these problems may be averted.

Unfortunately, the fired vessel burns in order to heat the fluid therein. This process produces unwanted exhaust gases that cause air pollution.

SUMMARY

For at least the reasons stated herein, there is a continuous unmet need for a system and method that reduces the amount of air pollution produced by fired vessels. Aspects of the present disclosure are directed to this continuous unmet need.

In one aspect, an exemplary embodiment of the present disclosure may provide a system for use with a fired vessel of production/separators or dehydration equipment. The system may include a metal fire box, a main burner, a pilot burner, and a first flame arrestor. The main burner and the pilot burner may be within the fire box. The first flame arrestor may be connected to the fire box.

In another aspect, an exemplary embodiment of the present disclosure may provide a system for use with a fired vessel, the system comprising: a box; a main burner within the box; a pilot burner within the box; and a first flame arrestor connected to the box. This exemplary embodiment or another exemplary embodiment may further provide wherein the first flame arrestor provides ambient air to the main burner and the pilot burner. This exemplary embodiment or another exemplary embodiment may further provide a tank; a tube within the tank, wherein the metal box is within the tube; and a fuel source connected to the main burner and the pilot burner, wherein the fuel source provides fuel to the main burner and the pilot burner. This exemplary embodiment or another exemplary embodiment may further provide wherein the metal box defines a first aperture, a second aperture, a third aperture, and a fourth aperture, and wherein the main burner extends through the first aperture and the second aperture and the pilot burner extends through the third aperture and the fourth aperture. This exemplary embodiment or another exemplary embodiment may further provide wherein the main burner and the pilot burner include a removable fitting and wherein the removable fitting of the main burner extends through the first aperture and the removable fitting of the pilot burner extends through the third aperture. This exemplary embodiment or another exemplary embodiment may further provide wherein the removable fitting of the main burner defines an opening that extends through the removable fitting and wherein the diameter of the opening is between 5/64" and 7/64". This exemplary embodiment or another exemplary embodiment may further provide wherein when the diameter of the opening is 5/64" the fuel flows through the main burner at about 4 psig. This exemplary embodiment or another exemplary embodiment may further provide wherein when the diameter of the opening is 7/64" the fuel flows through the main burner at about 3 psig. This exemplary embodiment or another exemplary embodiment may further provide wherein the first aperture, the third aperture, the removable fitting of the main burner and the removable fitting of the pilot burner include threads and wherein the threads of the first aperture interact with the threads of the removable fitting of the main burner and the threads of the third aperture interact with the threads of the removable fitting of the pilot burner. This exemplary embodiment or another exemplary embodiment may further provide wherein the main burner and the pilot burner include a venturi tube. This exemplary embodiment or another exemplary embodiment may further provide wherein the venturi tube of the main burner extends through the second aperture and the venturi tube of the pilot burner extends through the fourth aperture. This exemplary embodiment or another exemplary embodiment may further provide wherein the venturi tube of the main burner is connected to the removable fitting of the main burner and the venturi tube of the pilot burner is connected to the removable fitting of the pilot burner. This exemplary embodiment or another exemplary embodiment may further provide a second flame arrestor connected to the metal box. This exemplary embodiment or another exemplary embodiment may further provide wherein the metal box defines a fifth aperture and a sixth aperture and wherein the second flame arrestor is connected to the fifth aperture and a plug is connected to the sixth aperture. This exemplary embodiment or another exemplary embodiment may further provide wherein the first flame arrestor includes an inlet, an opening and a moveable plate that is moveable between an open position and a closed position and wherein ambient air enters the opening through the inlet. This exemplary embodiment or another exemplary embodiment may further provide wherein when in the moveable plate is in the open position, the pilot burner and the main burner burns fuel. This exemplary embodiment or another exemplary embodiment may further provide wherein when the moveable plate is in the closed position, the main burner does not burn fuel and the pilot burner burns fuel. This exemplary embodiment or another exemplary embodiment may further provide wherein the first flame arrestor includes a plunger connected to the moveable plate and a spring connected to the plunger.

In another aspect, an exemplary embodiment of the present disclosure may provide a method for supplying an air-fuel mixture to a main burner of a fire box. The method may include flowing an air-fuel mixture through a first orifice or fitting with a first diameter of a main burner of a fire box, wherein the fire box is connected to a fired vessel of a production/separators or dehydration equipment. The method may further include replacing the first orifice or fitting of the main burner with a second orifice or fitting, wherein the second fitting includes a second diameter. The method may further include flowing gas through the second orifice or fitting.

BRIEF DESCRIPTION OF THE SEVERAL VIEWS OF THE DRAWINGS

A sample embodiment of the disclosure is set forth in the following description, is shown in the drawings and is particularly and distinctly pointed out and set forth in the appended claims. The accompanying drawings, which are fully incorporated herein and constitute a part of the specification, illustrate various examples, methods, and other example embodiments of various aspects of the disclosure. It will be appreciated that the illustrated element boundaries (e.g., boxes, groups of boxes, or other shapes) in the figures represent one example of the boundaries. One of ordinary skill in the art will appreciate that in some examples one element may be designed as multiple elements or that multiple elements may be designed as one element. In some examples, an element shown as an internal component of another element may be implemented as an external component and vice versa. Furthermore, elements may not be drawn to scale.

Similar numbers refer to similar parts throughout the drawings.

DETAILED DESCRIPTION

Figure 1:
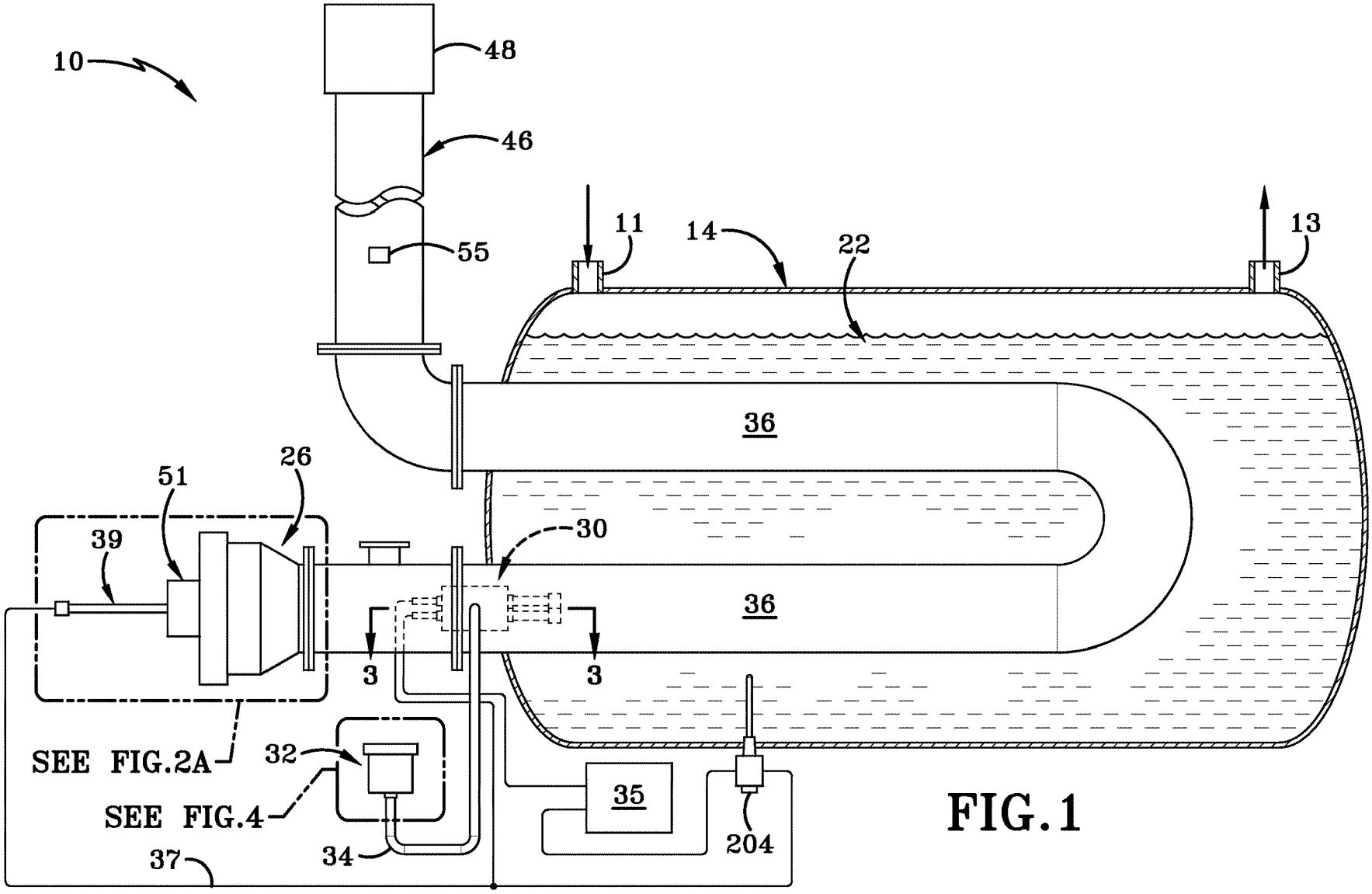
FIG. 1 is an operational partial cross section view of a fired vessel of a separator system with a firebox, a first flame arrestor, and a second flame arrestor.

FIG. 1 depicts a fired vessel 10. The fired vessel 10 may be used with any system that heats a liquid. The fired vessel 10 includes a raw gas inlet 11 and a separated gas outlet 13. The fired vessel 10 further includes a fuel source 35 that is connected via line 37 to cylinder 39 on a first flame arrestor 26. The fuel source 35 utilize the pressure in line 37 to operate cylinder 39. A second flame arrestor 32 provides air to the fire box 30 when the cylinder 39 is shut off or closed The first flame arrestor 26 intakes ambient air. The fired vessel 10 further includes a fire box 30 that is connected to the first flame arrestor 26 and a second flame arrestor 32. The fire box 30 is in open communication with the first flame arrestor 26 and a second flame arrestor 32. The second flame arrestor 32 is connected to the fire box 30 via a tube 34. The fire box 30 is further connected to the fuel source 35. The fire box 30 intakes combustible fuel from the fuel source 35 and mixes the fuel with the air from the second flame arrestor 32 thereby creating an air-fuel mixture inside venturi tubes.

The fire box 30 is further connected to a tube 36. The fire box 30 includes burners that burns the air-fuel mixture and outputs a heated exhaust. The tube 36 is surrounded by liquid 22. The heated exhaust passes through the tube 36 thereby heating the liquid 22 that surrounds the tube 36. Water and oil or condensate are separated. Oil is fed to production tanks and water is fed to a disposal tank. The tube 36 is connected to and in open communication with an exhaust stack 46. The exhaust stack 46 includes an outlet 48. The heated exhaust proceeds through the tube 36 and exits the exhaust stack 46 via the outlet 48. The stack 46 may include a stack analyzer plug 55. The plug 55 may be removed and a hand held stack analyzer may be used to sample exhaust fumes to determine the amount of emissions present. Much the same as vehicle exhaust. By setting fuel pressure to exact points with the correct burner system, 0% or nearly 0% combustibles emissions can be achieved.

Figure 2A:
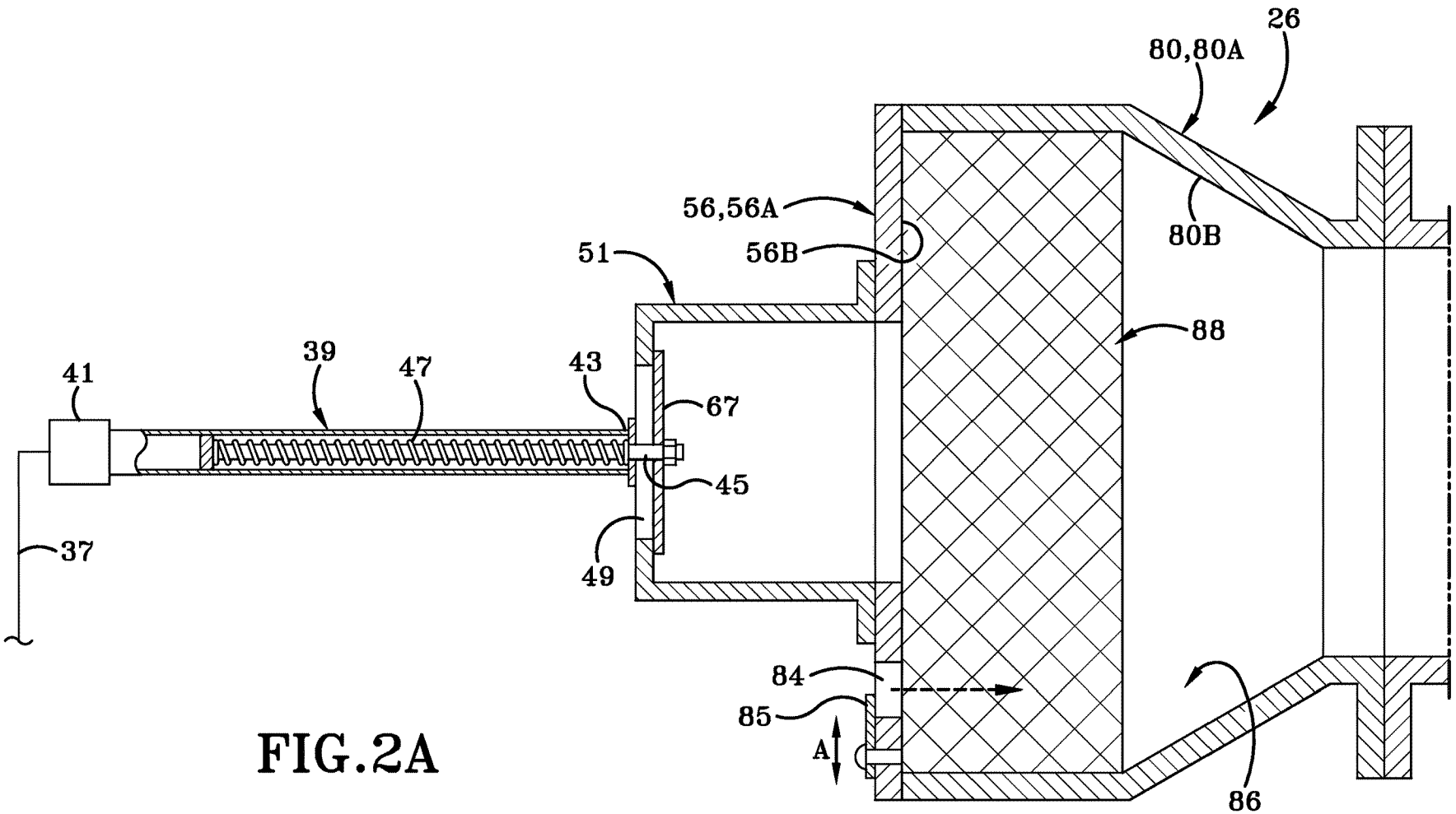
FIG. 2A is a cross sectional view of the first flame arrestor depicted in FIG. 1.
Figure 2B:
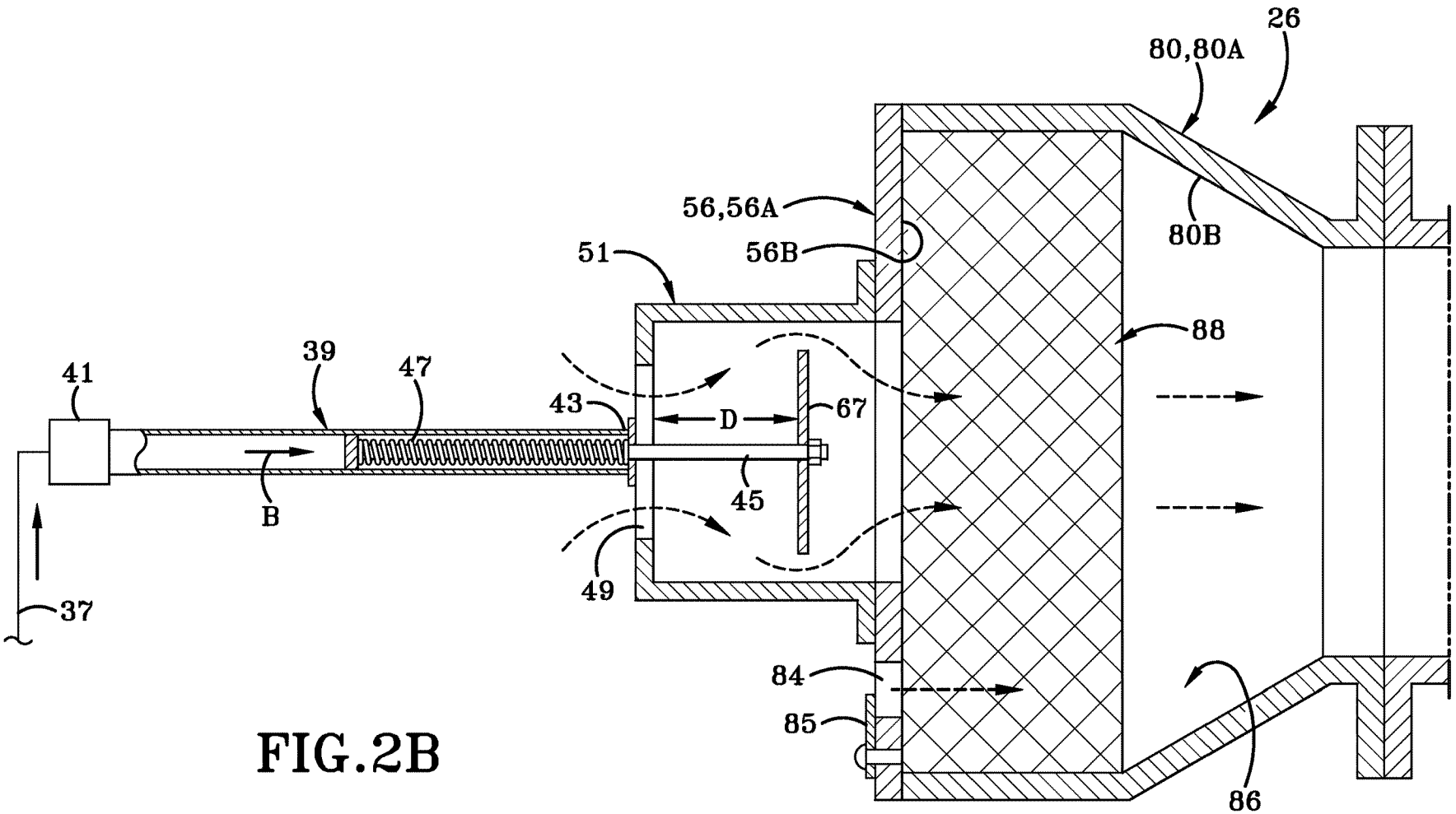
FIG. 2B is an operational cross section view of the first flame arrestor with cylinder moved to an open position to permit air to flow into the first flame arrestor.

FIG. 2A and FIG. 2B depicts the first flame arrestor 26 and the cylinder 39. The first flame arrestor 26 is generally cylindrical in shape and is connected to the cylinder 39. Cylinder 39 is operated by thermostat 204 that is installed in the vessel 10 (see FIG. 1). When the vessel 10 needs heat, the thermostat 204 allows fuel gas pressure to fire through the main burner and sends fuel gas pressure to cylinder 39 causing it to open. The is achieved through line 37 at approximately 12 psig to the cylinder 39. The cylinder 39 includes a first end 41 and a second end 43. The cylinder 39 houses a plunger or piston 45 that is biased closed by spring 47. The piston 45 is connected with a plate 67. Plate 67 translates relative to a longitudinal axis in response to movement of the piston 45. Piston 45 moves in response to pressure in line 37 being applied to the first end 41 of cylinder 39. The movement of plate 67 causes an opening 49 to opened and closed based on the position of plate 67. The opening 49 is defined in an end wall of a cylindrical housing 51. Cylindrical housing 51 has a length that accommodates at least 3 inches of longitudinal travel of the plate 67 during movement of the piston 45. Cylindrical housing 51 is connected with a plate 56. The plate 56 includes a first surface 56A and a second surface 56B that is opposite the first surface 56A. The first surface 56A of the plate 56 is connected to the cylindrical housing 51.

The plate 56 defines an opening 84. The opening 84 extends between the first surface 56A and the second surface 56B of the plate 56. The opening 84 may be selectively covered, either completely, partially, or not at all, by a cover 85, as indicated by arrow A. When plate 67 is closed, some of the air in fire box 30 enters through opening 84 and second flame arrestor 32. This allows enough air to maintain the pilot burner 92 firing continuously. In the blank plate cover 85 provides for manual adjustment to the air.

A flame arrestor air cell 88 is within the opening 86. The air cell 88 extends between opposing sides of the inner surface 80B of the third outer wall 80 that extends from the second surface 56B of the plate 56. An outer surface 80A of the third outer wall 80 is opposite the inner surface 80B. The opening 86 is in open communication with the fire box 30. In one particular example, the air cell 88 is about ten inches thick, measured in the direction of the longitudinal axis.

FIG. 2B operationally depicts the movement of plate 67. Pressure from line 37 is applied to the first end 41 of cylinder 39, which may be a pencil cylinder. The pressure applied to the cylinder 39 pushes the piston out from the second end 43 against the biasing force of spring 47. The piston 45 movement, as shown by Arrow B, causes plate 67 to release its engagement of the end wall that defines opening 49. The opening 49 is then considered to be in an open position to allow air flow to move though air cell 88. In one particular embodiment, the longitudinal dimension of travel of plate 67 is about 3 inches, as indicated by Arrow D.

With continued reference to FIG. 2B, piston 45 is moveable between an open position and closed position. FIG. 2B depicts the piston in the open position. When the spring 47 is in a first state, the spring 47 applies a force to the plate 67 to bias it closed against the interior surface of cylindrical housing 51. To move the piston, pressure in fuel line 37 from source 35 may apply a force to piston 45 that overcomes the force of spring 47. This force causes the spring 47 to extend to an extended second state. When open, ambient air that enters the opening 49. Ambient also enters the opening aperture 84. Ambient air through the aperture 84 when the cover 85 does not entirely cover aperture 84.

Figure 3:
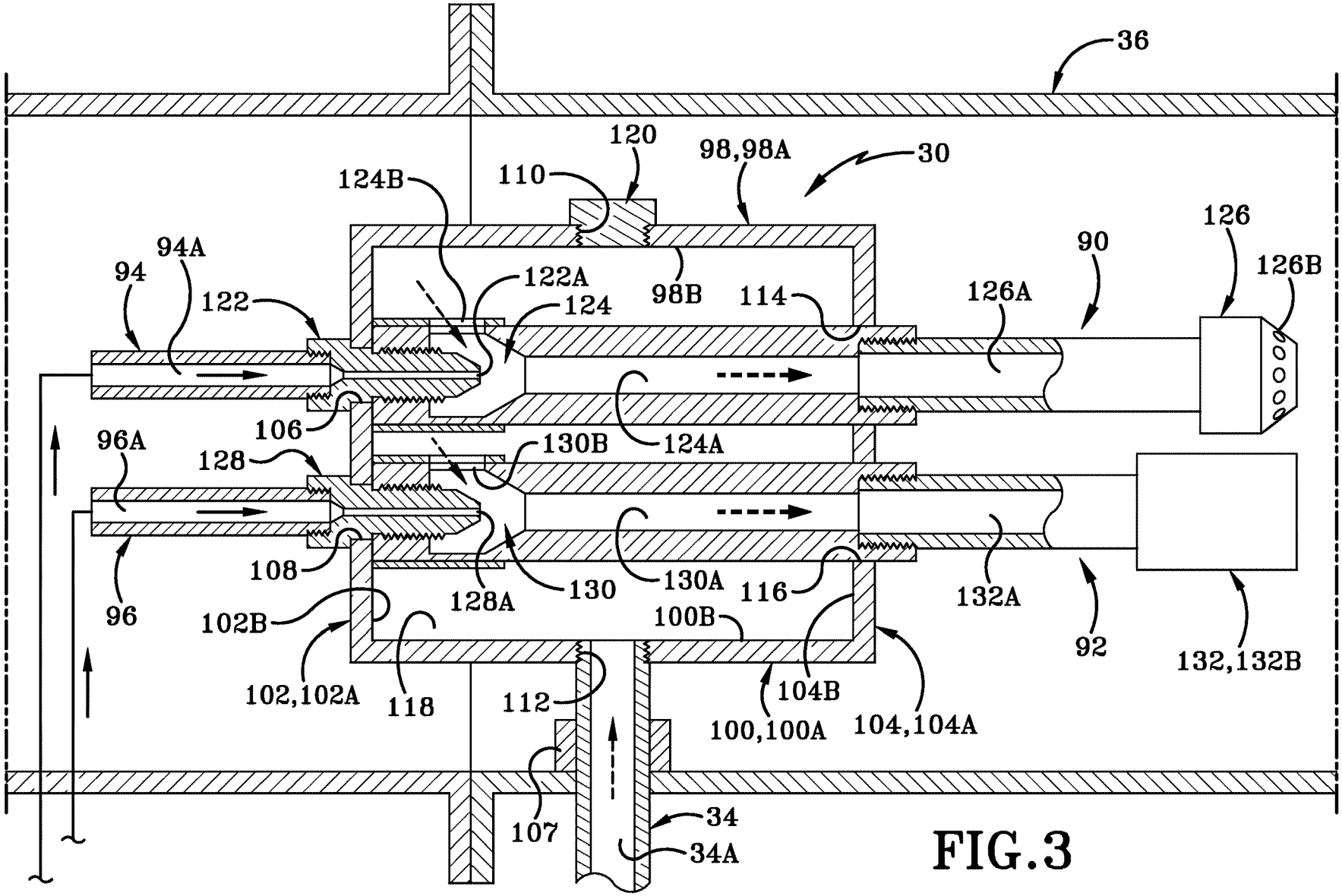
FIG. 3 is cross sectional view of the fire box depicted in FIG. 1 taken along the line 3-3.

FIG. 3 depicts the box 30 within the tube 36, a main burner 90, and a pilot burner 92. The main burner 90 connected to the fuel source 35 via a tube 94 and the pilot burner 92 is connected to the second fuel source 35 via a tube 96. The box 30 includes a first side wall 98, a second side wall 100 opposite the first side wall 98, a first end wall 102, and a second end wall 104 opposite the first end wall 102. The first side wall 98 and the second side wall 100 extend between the first end wall 102 and the second end wall 104. The first end wall 102 and the second side all 104 extend between the first side wall 98 and the second side wall 100. The first side wall 98, the side wall 100, the first end wall 102 and the second end wall 104 form the box 30 that houses the main burner 90 and the main burner 92. A clamp 107 attached to the tube 34 retains the fire box 30 in place.

The first side wall 98 includes an outer surface 98A and an inner surface 98B that is opposite the outer surface 98A. The second side wall 100 includes an outer surface 100A and an inner surface 100B that is opposite the outer surface 100A. The first end wall 102 includes an outer surface 102A and an inner surface 102B that is opposite the outer surface 102B. The outer surface 98A of the first side wall 98 and the outer surface 100A of the second side wall 100 extend between the outer surface 102A of the third outer wall and the outer surface 104A of the second outer wall. The inner surface 98B of the first side wall 98 and the inner surface 100B of the second side wall 100 extend between the inner surface 102B of the first end wall 102 and the inner surface 104B of the second end wall 104. The outer surface 102A of the first end wall 102 and the outer surface 104A of the second end wall 104 extend between the outer surface 98A of the first side wall 98 and the outer surface 100A of the second side wall 100. The inner surface 102B of the first end wall 102 and the inner surface 104B of the second end wall 104 extend between the inner surface 98B of the first side wall 98 and the inner surface 100A of the of the second side wall 100.

The first end wall 102 defines a first aperture 106 and a second aperture 108. The first aperture 106 and the second aperture 108 extend between the outer surface 102A and the inner surface 102B of the first end wall 102. The first side wall 98 defines a threaded aperture 110. The threaded aperture 110 extends between the outer surface 98A and the inner surface 98B of the first side wall 98. The second side wall 100 defines a threaded aperture 112. The threaded aperture 112 extends between the outer surface 100A and the inner surface 100B of the second side wall 100. The second end wall 104 defines a first aperture 114 and a second aperture 116. The first aperture 114 and the second aperture 116 extend between the outer surface 104A and the inner surface 104B of the second end wall 104. The inner surface 98B of the first side wall 98, the inner surface 100B off the second side wall 100, the inner surface 102B of the first end wall 102 and the inner surface 104B of the second end wall 104 define an opening 118.

The threaded aperture 110 or the threaded aperture 112 may be connected to the tube 34. While FIG. 3 depicts the tube 34 as connected to the threaded aperture 112, it is understood that the tube 34 may be connected to the threaded aperture 110. The tube 34 includes first threads and an opening 34A that extend through the tube 34. The first threads of the tube 34 interact with the threads of the threaded aperture 110 or threaded aperture 112 thereby connecting the tube 34 to the fire box 30. When connected to the fire box 30, the opening 34A of the tube 34 is in open communication with the opening 118 of the fire box 30. The fire box 30 further includes a plug 120. The plug 120 may be connected to the threaded aperture 110 or the threaded aperture 112. The plug 120 includes threads that interact with the threads of the threaded aperture 110 or the threads of the threaded aperture 112. While FIG. 3 depicts the plug 120 as connected to the threaded aperture 110 it is understood that the plug 120 may be connected to the threaded aperture 112. Plug 120 can be a ¾ inch collar. That ¾ inch collar or plug 120 is so an operator can take it out if there is not enough air feeding the burners to stay lit and burn at the right mixture.

The main burner 90 and the pilot burner 92 extend through the box 30. The main burner 90 includes a fitting 122, a venturi tube 124, and a burner 126. The pilot burner includes an orifice or fitting 128, a venturi tube 130 and a burner 132.

The fitting 122 extends from the outer surface 102A to the inner surface 102B through the first aperture 106 of the first end wall 102. The fitting 122 includes first threads, second threads, and defines an opening 122A. The first threads interact with threads of the tube 94 thereby connecting the fitting 122 to the tube 94. The opening 122A is in communication with an opening 94A of the tube 94 and extends through the fitting 122. The opening 94A is in communication with the opening 86 of the first flame arrestor 26.

The venturi tube 124 extends from the inner surface 102B of the first end wall 102 to the outer surface 104A of the second end wall 104 through the first aperture 114 of the second end wall 104. The venturi tube 124 includes first threads and second threads, and defines a first opening 124A and a second opening 124B. The first threads of the venturi tube 124 interact with the second threads of the fitting 122 thereby connecting the venturi tube 124 to the fitting 122. The first opening 124A of the venturi tube 124 is in open communication with the opening 122A of the fitting 122 and extends through the venturi tube 124. The burner 126 includes threads, defines an opening 126A, and a burner head 126B. The threads of the burner 126 interact with the second threads of the venturi tube 124 thereby connecting the venturi tube 124 to the burner 126. The opening 126A of the burner 126 is in open communication with the first opening 124A of the venturi tube 124 and extends through the burner 126.

The orifice 128 of the pilot burner 92 extends from the outer surface 102A to the inner surface 102B through the second aperture 108 of the first end wall 102. The orifice 128 includes first threads, second threads, and defines an opening 128A. The first threads interact with threads of the tube 96 thereby connecting the orifice or fitting 128 to the tube 96. The opening 128A is in communication with an opening 96A of the tube 96 and extends through the orifice or fitting 128. The opening 96A is in communication with the opening 86 if the first flame arrestor 26.

The venturi tube 130 extends from the inner surface 102B of the first end wall 102 to the outer surface 104A of the second end wall 104 through the second aperture 116 of the second end wall 104. The venturi tube 130 includes first threads, defines a first opening 130A, a second opening 130B, and second threads. The first threads of the venturi tube 130 interact with the second threads of the orifice or fitting 128 thereby connecting the venturi tube 130 to the orifice 128. The opening first 130A of the venturi tube 130 is in open communication with the opening 128A of the orifice 128 and extends through the venturi tube 130. The burner 132 includes threads, defines an opening 132A, and a burner head 132B. The threads of the burner 132 interact with the second threads of the venturi tube 130 thereby connecting the venturi tube 130 to the burner 132. The opening 132A of the burner 132 is in open communication with the first opening 130A of the venturi tube 130 and extends through the burner 132.

Fuel from the second fuel source 35 passes through the opening 94A of the tube 94 and enters the first opening 124A of the venturi tube 124 via the opening 122A of the fitting 122. Ambient air that has entered the fire box 30 passes through the opening 124B of the venturi tube 124 and mixes with the fuel from the second fuel source 35 thereby creating an air-fuel mixture within the venturi tube 124. The air-fuel mixture passes through the first opening 124A of the venture tube 124 and enters the opening 126A of the burner 126 and exits the burner 126 via the burner head 126B.

The diameter of the opening 122A of the fitting 122 may be 5/64". The fitting 122 may be removed and replaced with a different fitting 122, wherein the diameter of the opening 122A is more or less than 5/64" (i.e., 7/64" or 3/40") and as such may allow more or less fuel from the first fuel source 35 to flow through the fitting 122 thereby changing the pressure of the fuel that flows through the fitting 122. The pressure of the fuel that flows fitting 122 depends on the width of the opening 122A. The wider the opening 122A, the lower the psig. In one example, the diameter of the opening 122A is 5/64" and the fuel mixture that flows through the opening 122A at 4 psig. In another example, the diameter of the opening 122A is 7/64" and the fuel that flows through the opening 122A at 3 psig.

The stack analyzer that is inserted into the hole when plug 55 is removed determines the emissions present. Furthermore, the stack analyzer may detect that no or essentially no combustible gases that exit in the stack 46 unburned. These combustible gases that exit the stack 46 are wasted as the main burner 90 or the pilot burner 92 has failed to burn them. When the psig is 4, the stack analyzer plug 55 may determine no combustible gasses have exited the stack 46 which may save 47-81% of fuel.

Fuel from the second fuel source 35 passes through the opening 96A of the tube 96 and enters the first opening 130A of the venturi tube 130 via the opening 128A of the orifice or fitting 128. Ambient air that has entered the fire box 30 passes through the opening 130B of the venturi tube 130 and mixes with the fuel from the second fuel source 35 thereby creating an air-fuel mixture within the venturi tube 130. The air-fuel mixture passes through the first opening 130A of the venturi tube 130 and enters the opening 132A of the burner 132 and exits the burner 132 via the burner head 132B.

The pilot burner 92 may constantly be on. That is, the pilot burner 92 may constantly ignite the air-fuel mixture that exits the burner head 132B. The main burner 90 may be turned on and off depending on the temperature of the liquid 22 (FIG. 1) within the tank 14. The first fuel source 35 may be connected to a thermostat that determines the temperature of the liquid 22. When the temperature of the liquid 22 drops below a threshold, the first fuel source 35 releases fuel to move the piston 45 from the closed position to the open position thereby adding additional air to the air-fuel mixture within the venture tube 124 which turns on the main burner 90. When the temperature of the liquid 22 (FIG. 1) exceeds a threshold, the main burner may be turned off.

Figure 4:
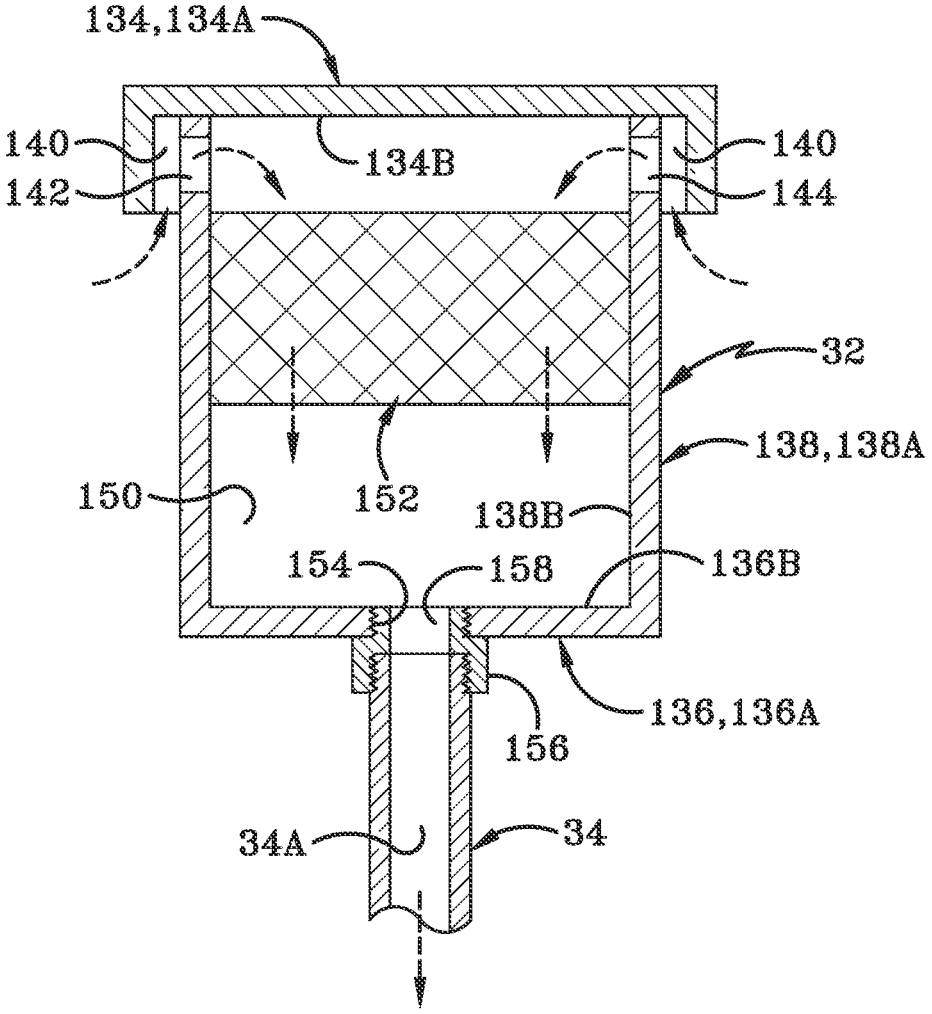
FIG. 4 is a cross sectional of the second flame arrestor depicted in FIG. 1.

FIG. 4 depicts the second flame arrestor 32. The second flame arrestor 32 is generally cylindrical in shape. The second flame arrestor 32 includes a first end wall 134, a second end wall 136 that is opposite the first end wall 134 and a side wall 138. The first end wall 134 contacts the side wall 138 and extends beyond opposing sides of the side wall 138. The second end wall 136 extends between opposing sides of the side wall 138. The sidewall 138 extends between the first end wall 134 and the second end wall 136. The first end wall 134 includes an outer surface 134A and an inner surface 134B that is opposite the outer surface 134A. The second end wall 136 includes an outer surface 136A and an inner surface 136B that is opposite the outer surface 136A. The side wall 138 includes an outer surface 138A and an inner surface 138B that is opposite the outer surface 138A.

The outer surface 134A of the first end wall 134 extends beyond opposing sides of the outer surface 138A of the side wall 138. The inner surface 134B of the first end wall 134 contacts opposing sides of the side wall 138 and extends beyond opposing sides of the outer surface 138A of the side wall 138.

The outer surface 136A of the second end wall 32 extends between opposing sides of the outer surface 138A of the side wall 138. The inner surface 136B of the second end wall extends between opposing sides of the inner surface 138B of the side wall 138. The outer surface 138A of the side wall 138 extends between the inner surface 134B of the first end wall 134 and the outer surface 136A of the second end wall 136. The inner surface 138B of the side wall 138 extends between the inner surface 134B of the first end wall 134 and the inner surface 136B of the second end wall 136.

The inner surface 134B of the first end wall 134 and the outer surface 138A of the side wall 138 define an opening 140. The side wall 138 defines a first aperture 142, a second aperture 144, a third aperture (not shown), and a fourth aperture (not shown). The first aperture 142, the second aperture 144, the third aperture, and the fourth aperture extend between the outer surface 138A and the inner surface 138B of the side wall 138. The first aperture 142, the second aperture 144, the third aperture, and the fourth aperture are in open communication with the opening 140. The inner surface 134B of the first end wall 134, the inner surface 136B of the second end wall 136, and the inner surface 136B of the side wall 138 define an opening 150. The first aperture 142, the second aperture 144, the third aperture, and the fourth aperture are in open communication with the opening 150. The second flame arrestor 32 further includes an air cell 152 that is within the opening 150. The second air cell 152 extends between opposing sides of the inner surface 138B of the side wall 138.

The second end wall 136 defines an aperture 154. The aperture 154 extends between the outer surface 136A and the inner surface 136B of the second end wall 136. The second flame arrestor 32 further includes a fitting 156. The fitting 156 defines an opening 158 that extends through the fitting 156. The fitting extends from the outer surface 136A to the inner surface 136B of the second end wall 136 via the aperture 154. The fitting 156 is connected to the aperture 154. The tube 34 is connected to the fitting 156. The opening 158 of the fitting 156 is in open communication with the opening 150 of the second flame arrestor 32 and the opening 34A of the tube 34.

Additional ambient air enters the fire box 30 via the second flame arrestor 32. Ambient air may enter the opening 140 and pass through the first aperture 142, the second aperture 144, the third aperture 146, and the fourth aperture 148 into the opening 150. The ambient air may then pass through the opening 158 of the fitting 156 and into the opening 34A of the tube 34. The ambient air may pass through the opening 34A of the tube 34 and into the opening 118 of the fire box 30. The ambient air may then pass through the second opening 124B of the venturi tube 124 or the second opening 130B of the venturi tube 130 where it may mix with the air-fuel mixture of the main burner 90 or the air-fuel mixture of the pilot burner 92.

Having thus described the configuration of embodiments to the present disclosure, reference is now made to some additional advantages and benefits for specific implementations. In one particular embodiment, an advantageous configuration is a 6 inch diameter tube 36, a 6 inch diameter stack 46 that is 12 feet tall.

The stack analyzer that occupies the hole when stack analyzer plug 55 is removed on the stack 46 has been used in oil and gas fired vessels in the past. The stack analyzer analyzes emissions so that fuel gas may be saved and emissions reduced. The portable stack analyzer monitors and analyzes the free stack emissions and by setting the exact fuel gas pressures may achieve 0 or essentially 0 combustible gases to the atmosphere. In the past the stack analyzer was used to achieve near zero combustible gases, but did not have knowledge of the saving available with the correct burner system and exact pressure settings of fuel gas.

Figure 5:
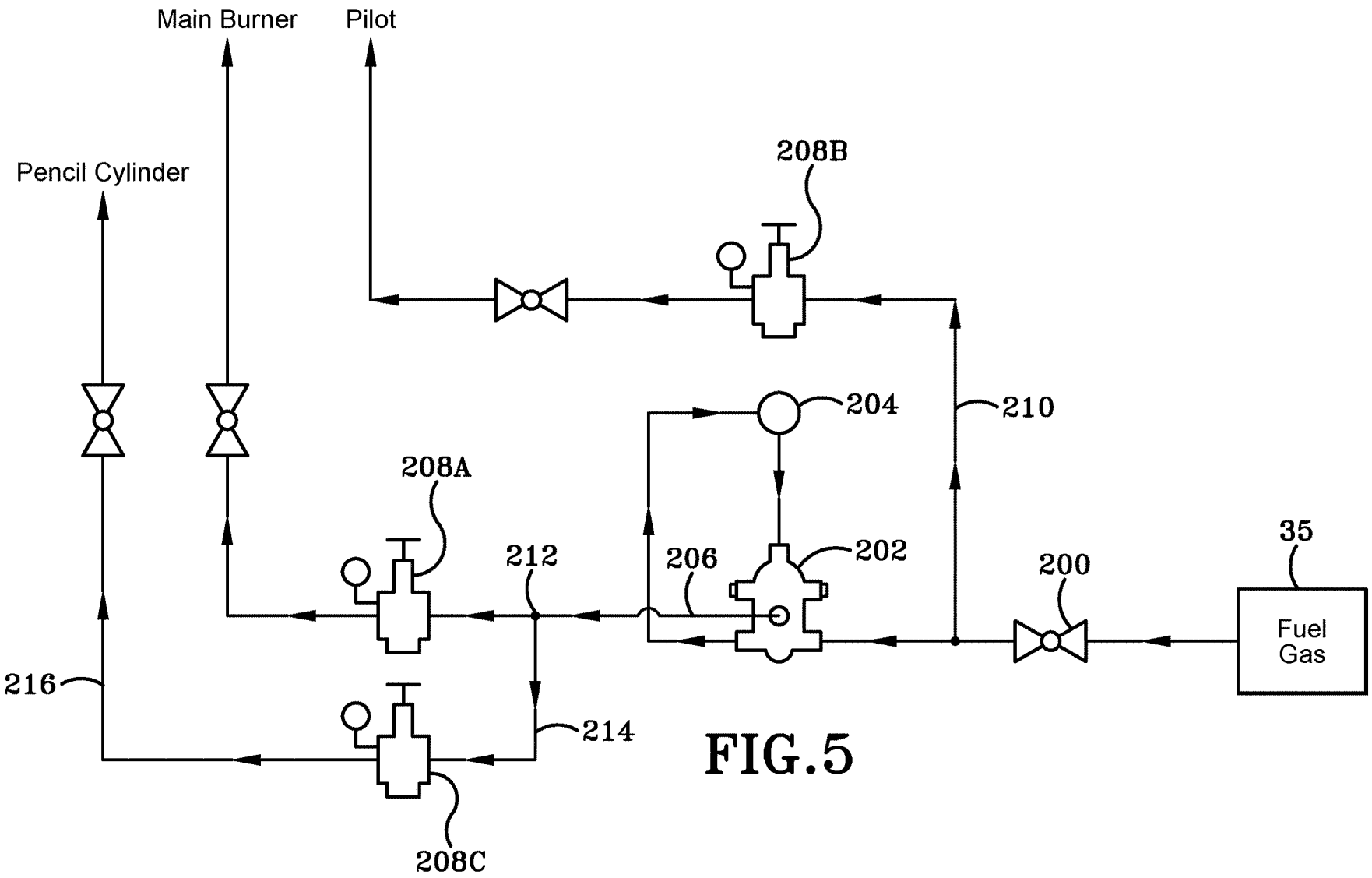
FIG. 5 is a schematic view of the operation of the burner system.

FIG. 5 depicts the operation of the system of the present disclosure. Fuel gas enters from fuel source 35. Fuel moves through a first regulator 200. As fuel leaves regulator 200, the fuel enters a 3PG 202 having five ports. Fuel gas passes through the 3PG 202 and flows to the thermostat 204. The thermostat 204 controls whether the pencil cylinder 39 is to be opened or closed, recalling that the cylinder 39 is spring closed, pressure opened. From the thermostat 204, the fuel line enters the 3PG 202 again to put pressure down on a diaphragm inside of the 3PG that will open up the line 206 that is coming off of the center. The 3PG is like the cylinder inasmuch as it is pressure opened, spring closed. So the 3PG 202 should not fail open. It is undesirable to fail open because it will just keep getting hot until it burns the vessel down.

Line 206 enters into a Fisher 67FR regulator 208A to reduce the pressure in the line. To view the reduced that pressure, there may be a gauge on the regulator 208A that shut that gauge at four psi for the main burner 132. The four psi is optimized for the 5/64 inch orifice 128, which is the most common orifice size in the oil and gas industry. This combination will save the suggested fuel gas 47% to 81% A and the same amount of combustible gases will be reduced. The fuel gas enters into the box 30 from regulator 208A and it is hooked to the main burner 132.

Regarding fuel to the pilot burner 126, the fuel enters into a Fisher 67FR regulator 208B from fuel line 210 that is connected to the fuel source 35 upstream from the 3PG 202.

Referring back to line 206, there is a T-junction 212. From junction 212, a line 214 is connected to another Fisher 67FR regulator 208C. From regulator 208C, the pressure in line 216 is used to move pencil cylinder 39. The pressure upstream from the 3PG 202 is usually about 25 psi. When moving along line 216 subsequent to the 67FR regulator 208C the pressure in the line has been reduced to about 12 psi to move the piston 45 of cylinder 39.

The process associated with present disclosure may be critical. With the fuel gas settings, the main burner with that size orifice 128 which is a 5/64th inch orifice and 4 psi it only at that pressure that size orifice will it achieve essentially zero combustible gases out the stack 46. If there was more pressure of gas, and the system would be gas rich and it wouldn't work to reduce gas emissions. If it had 3 psi of gas it would be lean. If there was 5 psi of gas at that size orifice you would be methane rich. If there is too much air going to it, the stack analyzer would show that there is more oxygen output and the emission ratio would be different. That exact 4 psi pressure, and the use of a stack analyzer, the information will confirm that effectively no combustible emission will be present. When the diameter of the stack is 6 inches, and the stack height is 12 feet, with an air diverter installed atop the stack.

Various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

The above-described embodiments can be implemented in any of numerous ways. For example, embodiments of technology disclosed herein may be implemented using hardware, software, or a combination thereof. When implemented in software, the software code or instructions can be executed on any suitable processor or collection of processors, whether provided in a single computer or distributed among multiple computers. Furthermore, the instructions or software code can be stored in at least one non-transitory computer readable storage medium.

All definitions, as defined and used herein, should be understood to control over dictionary definitions, definitions in documents incorporated by reference, and/or ordinary meanings of the defined terms.

The articles "a" and "an," as used herein in the specification and in the claims, unless clearly indicated to the contrary, should be understood to mean "at least one." The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "above", "behind", "in front of", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal", "lateral", "transverse", "longitudinal", and the like are used herein for the purpose of explanation only unless specifically indicated otherwise.

Although the terms "first" and "second" may be used herein to describe various features/elements, these features/elements should not be limited by these terms, unless the context indicates otherwise. These terms may be used to distinguish one feature/element from another feature/element. Thus, a first feature/element discussed herein could be termed a second feature/element, and similarly, a second feature/element discussed herein could be termed a first feature/element without departing from the teachings of the present invention.

An embodiment is an implementation or example of the present disclosure. Reference in the specification to "an embodiment," "one embodiment," "some embodiments," "one particular embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment," or "other embodiments," or the like, are not necessarily all referring to the same embodiments.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical range recited herein is intended to include all sub-ranges subsumed therein.

Additionally, any method of performing the present disclosure may occur in a sequence different than those described herein. Accordingly, no sequence of the method should be read as a limitation unless explicitly stated. It is recognizable that performing some of the steps of the method in a different order could achieve a similar result.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures.

In the foregoing description, certain terms have been used for brevity, clarity, and understanding. No unnecessary limitations are to be implied therefrom beyond the requirement of the prior art because such terms are used for descriptive purposes and are intended to be broadly construed.

Moreover, the description and illustration of various embodiments of the disclosure are examples and the disclosure is not limited to the exact details shown or described.

What is claimed:

1. A system for use with a fired vessel, the system comprising:

a tank containing a volume of liquid;

a tube submerged in the volume of liquid within the tank, a metal box defining an interior volume, wherein the metal box is within the tube and adjacent one end of the tube;

a main burner that extends through the metal box and a first venturi tube within the main burner;

a pilot burner that extends through the metal box and adjacent the main burner, and a second venturi tube within the pilot burner;

wherein the first venturi tube of the main burner is connected to a first fitting of the main burner and the second venturi tube of the pilot burner is connected to a second fitting of the pilot burner;

a first flame arrestor connected to the tube, wherein the first flame arrestor defines an air-intake opening, and a moveable plate operatively connected the first flame arrestor at the air-intake opening, wherein the moveable plate moves between a closed first position and an open second position via a plunger, wherein the first flame arrestor provides ambient air to the main burner and the pilot burner when the moveable plate is in the open second position; and a second flame arrestor connected to the metal box, wherein the second flame arrestor is adapted to create an air-fuel mixture inside the first and second venturi tubes;

wherein the system is adapted to be coupled to a fuel source to supply fuel to the main burner and the pilot burner.

2. The system of claim 1, wherein the metal box defines a first aperture, a second aperture, a third aperture, and a fourth aperture, and wherein the main burner extends through the first aperture and the second aperture and the pilot burner extends through the third aperture and the fourth aperture.

3. The system of claim 2, wherein the main burner and the pilot burner include a removable fitting and wherein the removable fitting of the main burner extends through the first aperture and the removable fitting of the pilot burner extends through the third aperture.

4. The system of claim 3, wherein the removable fitting of the main burner defines an opening that extends through the removable fitting and wherein the diameter of the opening is between 5/64" and 7/64".

5. The system of claim 4, wherein when the diameter of the opening is 5/64" the fuel flows through the main burner at about 4 psig.

6. The system of claim 5, wherein when the diameter of the opening is 7/64" the fuel flows through the main burner at about 3 psig.

7. The system of claim 3, wherein the first aperture, the third aperture, the removable fitting of the main burner and the removable fitting of the pilot burner include threads and wherein the threads of the first aperture interact with the threads of the removable fitting of the main burner and the threads of the third aperture interact with the threads of the removable fitting of the pilot burner.

8. The system of claim 7, wherein each of the main burner and the pilot burner includes a venturi tube.

9. The system of claim 8, wherein the venturi tube of the main burner extends through the second aperture and the venturi tube of the pilot burner extends through the fourth aperture.

10. The system of claim 8, wherein the venturi tube of the main burner is connected to the removable fitting of the main burner and the venturi tube of the pilot burner is connected to the removable fitting of the pilot burner.

11. The system of claim 2, further comprising a second flame arrestor connected to the metal box.

12. The system of claim 2, wherein the metal box defines a fifth aperture and a sixth aperture and wherein the second flame arrestor is connected to the fifth aperture and a plug is connected to the sixth aperture.

13. The system of claim 12, wherein the first flame arrestor includes an inlet, an opening and a moveable plate that is moveable between an open position and a closed position and wherein ambient air enters the opening through the inlet.

14. The system of claim 13, wherein when in the moveable plate is in the open position, the pilot burner and the main burner burns fuel.

15. The system of claim 13, wherein when the moveable plate is in the closed position, the main burner does not burn fuel and the pilot burner burns fuel.

16. The system of claim 13, wherein the first flame arrestor includes a plunger connected to the moveable plate and a spring connected to the plunger.

* * * * *